US007530464B2

(12) United States Patent
Guo

(10) Patent No.: US 7,530,464 B2
(45) Date of Patent: May 12, 2009

(54) COMBINATION OF A SHELF AND A HOLDING FRAME

(75) Inventor: Ying-Jun Guo, Shenzhen (CN)

(73) Assignees: Innocom Technology (Shenzhen) Co., Ltd., Shenzhen, Guangdong Province (CN); Innolux Display Corp., Miao-Li County (TW)

( * ) Notice: Subject to any disclaimer, the term of this patent is extended or adjusted under 35 U.S.C. 154(b) by 605 days.

(21) Appl. No.: 11/178,941

(22) Filed: Jul. 11, 2005

(65) Prior Publication Data

US 2006/0006127 A1 Jan. 12, 2006

(30) Foreign Application Priority Data

Jul. 9, 2004 (TW) ..... 93120646 A

(51) Int. Cl.
*A47F 7/18* (2006.01)

(52) U.S. Cl. ..... 211/26; 211/44

(58) Field of Classification Search ..... 211/26, 211/1.51–1.57, 94.01, 134, 189, 44
See application file for complete search history.

(56) References Cited

U.S. PATENT DOCUMENTS

| | | | | |
|---|---|---|---|---|
| 4,373,904 | A * | 2/1983 | Smith | 431/328 |
| 4,820,372 | A * | 4/1989 | Gidseg | 156/356 |
| 5,584,404 | A * | 12/1996 | Tsai | 211/94.01 |
| 2003/0201203 | A1 | 10/2003 | Fast et al. | |
| 2004/0020883 | A1 * | 2/2004 | Brokaw | 211/89.01 |
| 2004/0177573 | A1 * | 9/2004 | Newhouse et al. | 52/239 |
| 2004/0222344 | A1 * | 11/2004 | Oddsen, Jr. | 248/278.1 |
| 2007/0056921 | A1 * | 3/2007 | Lo | 211/94.01 |
| 2008/0000861 | A1 * | 1/2008 | Muellerleile | 211/94.01 |

* cited by examiner

*Primary Examiner*—Jennifer E. Novosad
(74) *Attorney, Agent, or Firm*—Wei Te Chung

(57) ABSTRACT

A combination of a shelf (5) and a holding frame (4). The holding frame has a strip-shaped plate (42) having a rectangular cross-section. The shelf includes a first combinative plate (52). The first combinative plate has a through slot (523), and a cross section of the through slot is ⊏shaped. A stop is disposed in an upper part or a lower part of an open of the through slot, and the through slot fixed the holding frame in the strip-shaped plate. With the combination, the shelf and the holding frame can be combined or disassembled conveniently and quickly.

5 Claims, 4 Drawing Sheets

COMBINATION OF A SHELF AND A HOLDING FRAME

FIELD OF THE INVENTION

The present invention relates to the combination of a shelf and a holding frame employed in a hot press arrangement typically of a liquid crystal display (LCD) manufacturing process.

BACKGROUND

Referring to FIG. 6, in a step of assembling a typical LCD module, a driver integrated circuit (IC) 16 and a printed circuit board (PCB) 17 are needed to be attached together and electrically connected. Generally the driver IC 16 and the PCB 17 can be pressfitted together using a hot press arrangement, in which an anisotropic conductive film (ACF) 18 is interposed between the driver IC 16 and PCB 17 in order to electrically interconnect them. A typical hot press arrangement includes a hot pressing head 11 and a supporting table 12. The supporting table 12 is used for supporting the driver IC 16 and the PCB 17. The hot pressing head 11 can move up and down relative to the supporting table 12 to pressfit all the elements together at a high temperature.

The process of press fitting the driver IC 16 and the PCB 17 includes the steps of:

a) placing the PCB 17 on the supporting table 12, and arranging the ACF 18 on a circuit area (not shown) of the PCB 17;

b) placing the driver IC 16 on the ACF 18, so that a circuit area (not shown) of the driver IC 16 overlaps a circuit area (not shown) of the PCB 17;

c) arranging a Teflon® band 15 between the hot pressing head 11 and the driver IC 16; and d) pressing down the hot pressing head 11, thereby applying a pressure on the Teflon® band 15, the driver IC 16 and the PCB 17, thereby deforming the ACF 18, whereby the driver IC 16 and the PCB 17 are electrically interconnected.

The Teflon® band 15 buffers a pressure from the hot pressing head 11, and transfers uniform pressure and heat to the driver IC 16 and the PCB 17. After the step d), the Teflon® band 15 is moved a predetermined distance to be located at a new segment between the hot pressing head 11 and the driver IC 16, in order to protect the hot pressing head 11 from being contaminated.

Generally, the Teflon® band 15 is installed on a shelf. A typical shelf 2 shown in FIG. 7 includes two side frames 21, a first combinative plate 22, an expansile screw 23, an enrolling cylinder 24, a rotating shaft 26, and a plurality of stiffeners 27.

Also referring to FIG. 8, the two side frames 21 are disposed opposite to each other. The stiffeners 27 are arranged between the side frames 21, and are parallel to each other. Thus the stiffeners 27 and the side frames 21 cooperatively define a fixed frame. The side frames 21 are strip-shaped, and each side frame 21 has two ends. One end of each side frame 21 has a U-shaped groove 212, and the other end of the side frame 21 has a first C-shaped groove 211.

The expansile screw 23 has two ends. Each end of the expansile screw 23 has a first shaft 234, and a first connecting protrusion 233 having a second C-shaped groove 2331. Corresponding adjacent first and second C-shaped grooves 211, 2331 communicate with each other and define a circular through hole. A corresponding first shaft 234 can be rotatably received in the circular through hole. Each of the first shafts 234 has a bead 232. The beads 232 of the first shafts 234 touch against the first connecting protrusions 233 to ensure the expansile screw 23 can rotate freely but not move in horizontal directions.

The expansile screw 23 is fixed on the side frames 21. However, the side frames 21 are short; that is, a distance between the expansile screw 23 and the side frames 21 is narrow, and not enough to accommodate the reel of Teflon® band 15. Thus the expansile screw 23 has to have a sleeve 231 attached thereon.

The enrolling cylinder 24 has two ends, and each end has a second shaft 242. The second shaft 242 mates in the U-shaped grooves 212 and can rotate therein. When the second shaft 242 is forced to move up, the second shaft 242 may escape from the U-shaped grooves 212. Each side frame 21 has a locating block 25 formed thereon. The locating blocks 25 are oriented tangentially to the second shaft 242, so as to prevent the second shaft 242 from moving too far up and escaping from the U-shaped grooves 212. A baffle plate 243 is arranged on an outside of each side frame 21, so that it covers the U-shaped groove 212. The baffle plates 243 of the side frames 21 block the second shaft 242, to ensure that the second shaft 242 can rotate freely but not move in horizontal directions.

The rotating shaft 26 is adjacent to the enrolling cylinder 24 and parallel to the expansile screw 23. The rotating shaft 26 is driven to rotate, and thereby drives the second shaft 242 to rotate via gears (not labeled). Thus, used Teflon® band 15 is wound around the enrolling cylinder 24.

Referring to FIG. 9, when the shelf 2 is working, the shelf 2 has to be fixed on a holding frame 4, and the holding frame 4 can bring the shelf 2 to a predetermined position. The shelf 2 and the holding frame 4 are combined by the first combinative plate 22.

The holding frame 4 includes an arm 41, a transverse plate 42, and a second combinative plate 43. The transverse plate 42 is connected with the second combinative plate 43 by two second connecting protrusions 47, in order to strength the holding frame 4. Two ends of the second combinative plate 43 have two through holes 45 and 46 respectively. The first combinative plate 22 has a pair of posts 221 thereon. The posts 221 mate in the through holes 45 and 46, in order to fix the first combinative plate 22 on the second combinative plate 43 and prevent the shelf 2 from moving in horizontal directions. Two bolts 44 are inserted into two corresponding bolt holes 222 in the first combinative plate 22, thereby fastening the shelf 2 on the holding frame 4.

The combination of the shelf 2 and the holding frame 4 has some disadvantages. Firstly, the hot pressing head 11 usually works at temperatures as high as 380° C. When an operator uses his/her fingers to unscrew the bolts 44 to replace the Teflon® band 15, the fingers may touch the hot pressing head 11 and be scalded. Secondly, it takes an unduly long time to mate the bolts 44 and the posts 221 to fix the shelf 2.

Therefore, a new combination of a shelf and a holding frame that can overcome the above-described problems is desired.

SUMMARY

In a preferred embodiment, a combination of a shelf and a holding frame, wherein the holding frame has a strip-shaped plate with a rectangular cross-section. The shelf includes a first combinative plate. The first combinative plate has a through slot, and a cross section of the through slot is ⊏shaped. A stop is disposed in an upper part or a lower part of an open of the through slot, and the through slot fixed the holding frame in the strip-shaped plate.

The combination of a shelf and a holding frame has the following advantages. On the one hand, the shelf and the second combinative plate can be locked thus the shelf and the holding frame can be combined or disassembled conveniently and quickly. In the operation, a hand of an operator needs not approach the hot pressing head and is safe. On the other hand, a reel of coiled material can be installed on the shelf and no coiled material need to be divided into one or more parts, thus no coiled material is wasted.

Other advantages and novel features will become more apparent from the following detailed description when taken in conjunction with the accompanying drawings.

DETAILED DESCRIPTION OF PREFERRED EMBODIMENTS

Figure 1:
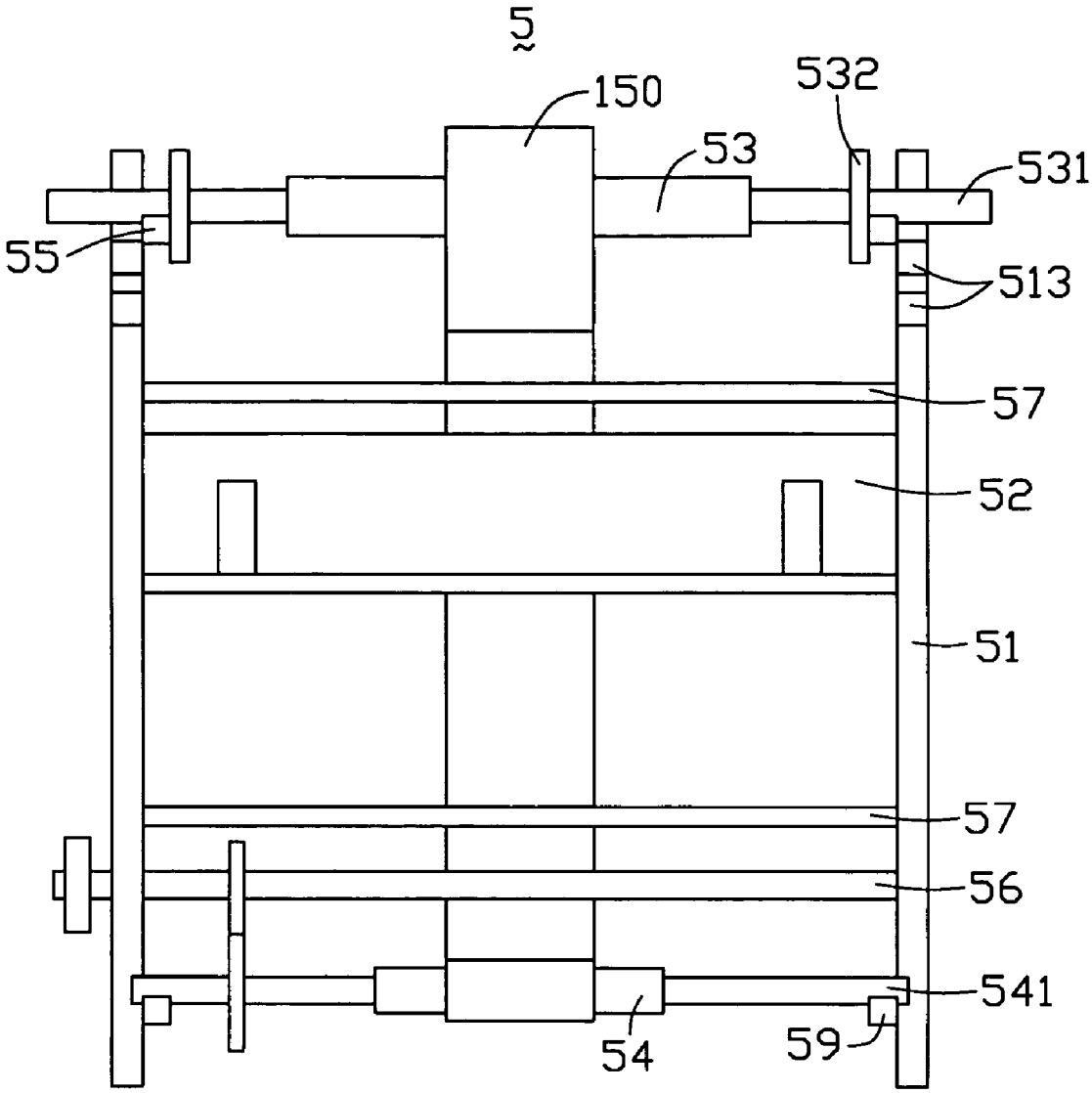
FIG. 1 is a top view of a shelf according to a first embodiment of the present invention.
Figure 9:
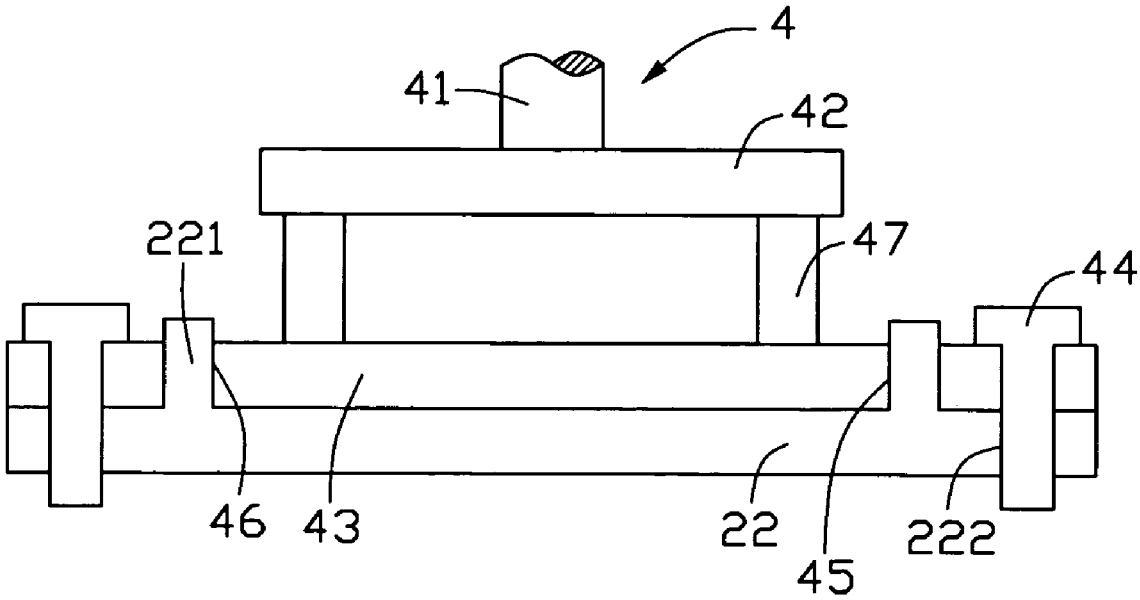
FIG. 9 is a schematic, side cross-sectional view of a combination of a holding frame and a combinative plate of the shelf of FIG. 7.

A combination of a shelf and a holding frame includes a shelf and a holding frame. A shelf 5 according to a first embodiment is shown in FIG. 1. The holding frame can be the same as or similar to the holding frame 4 shown in FIG. 9. The shelf 5 includes two side frames 51, a first combinative plate 52, an expansile screw 53, an enrolling cylinder 54, a third rotating shaft 56, and a plurality of stiffeners 57.

Figure 2:
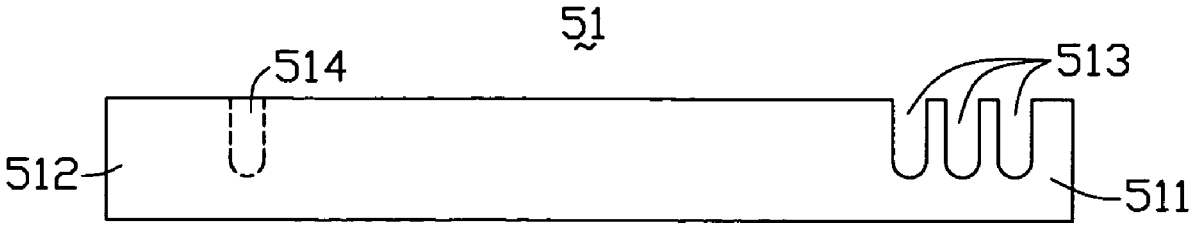
FIG. 2 is a side view of one side frame of the shelf of FIG. 1.

Also referring to FIG. 2, the side frames 51 are disposed parallel and opposite to each other. The stiffeners 57 are arranged between the two side frames 51, and are parallel to each other. Thus the side frames 51 and the stiffeners 57 cooperatively define a fixed frame. The side frames 51 are strip-shaped, and each side frame 51 includes a first end 511 and a second end 512. The first end 511 has a plurality of first U-shaped grooves 513, each of which is a through groove. The second end 512 has a second U-shaped groove 514. The second U-shaped groove 514 is a blind groove.

The expansile screw 53 has two ends, and each end has a first rotating shaft 531. The first rotating shafts 531 are arranged in two corresponding opposite of the first U-shaped grooves 513, and can rotate therein. A length of the expansile screw 53 changes when the expansile screw 53 expands. Thus distal ends of the first rotating shaft 531 protrude out from the side frames 51 respectively.

When the first rotating shaft 531 is forced to move up, the first rotating shaft 531 may escape from the first U-shaped grooves 513. Accordingly, the side frames 51 have two first locating blocks 55 provided thereon respectively. The first locating blocks 55 are oriented tangentially to the first rotating shaft 531, in order to prevent the first rotating shaft 531 from moving up too far and escaping from the first U-shaped grooves 513. The first rotating shaft 531 has two beads 532 fixed thereon. The beads 532 touch against the first locating blocks 55, to ensure that the expansile screw 53 can rotate freely but not move in horizontal directions.

A reel of Teflon® band 150 is installed onto the expansile screw 53 by a socket joint, and is adjusted to a proper position. Then the expansile screw 53 is expanded and the reel of the Teflon® band 150 is fixed. An arrangement of the Teflon® band 150 is thus accomplished.

The enrolling cylinder 54 has two ends, and each end has a second rotating shaft 541. The second rotating shafts 541 mate in the second U-shaped grooves 514 and can rotate therein. Because the second U-shaped grooves 514 are blind grooves, the enrolling cylinder 54 can rotate freely therein and not move in horizontal directions.

When the second rotating shaft 541 is forced to move up, the second rotating shaft 541 may escape from the second U-shaped grooves 514. Accordingly, the side frames 51 have a pair of second locating blocks 59 provided thereon respectively. The second locating blocks 59 are oriented tangentially to the second rotating shaft 541, in order to prevent the second rotating shaft 541 from moving up too far and escaping from the second U-shaped grooves 514.

The third rotating shaft 56 is arranged adjacent to the enrolling cylinder 54, and has two ends. The third rotating shaft 56 is driven to rotate, thereby driving the second rotating shaft 541 to rotate via gears (not labeled). Thus, used Teflon® band segments are wound around the enrolling cylinder 54.

Figure 3:
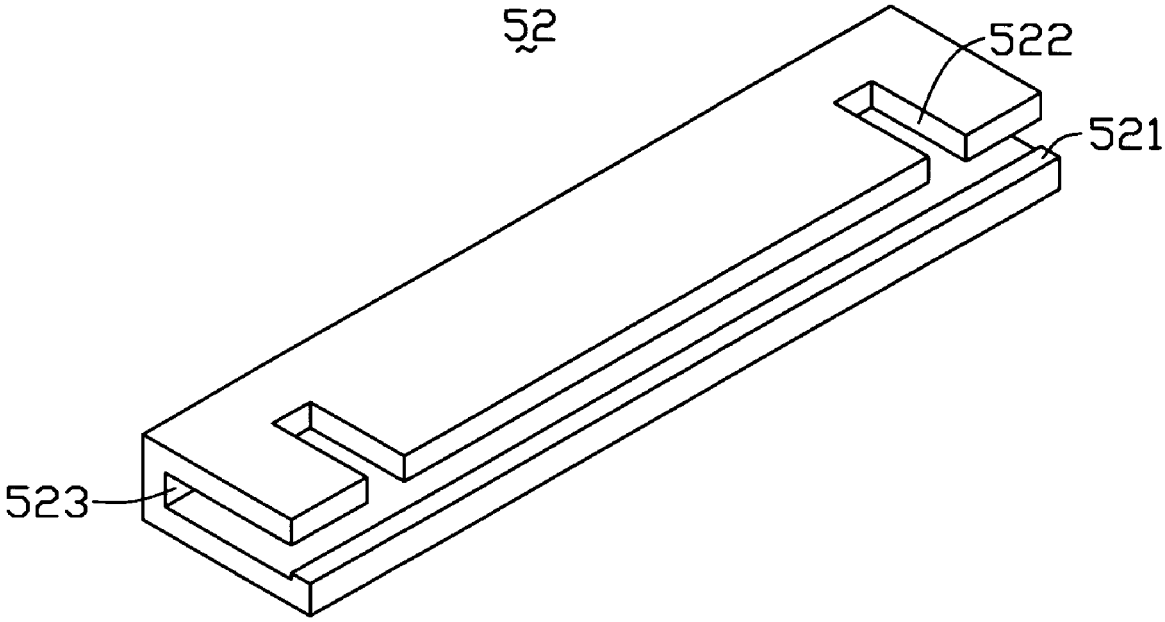
FIG. 3 is an isometric view of a first combinative plate of the shelf of FIG. 1.

Also referring to FIG. 3, the first combinative plate 52 is arranged on the two side frames 51, and is parallel to the expansile screw 53. The first combinative plate 52 and the two side frames 51 are disposed between the expansile screw 53 and the enrolling cylinder 54. The first combinative plate 52 has a slot 523, and the slot 523 has a ⊏shaped cross-section. The lower part of an opening of the slot 523 has a stop 521 formed thereat. The upper part of the first combinative plate 52 has two rectangular cuts 522 defined therein. The two rectangular cuts 522 are used for mating of the first combinative plate 52 with the second connecting protrusions 47 (shown in FIG. 9).

Figure 4:
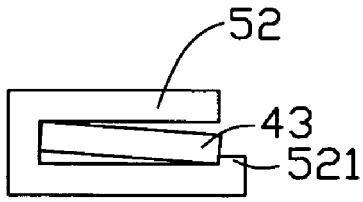
FIG. 4 is a side view of the first combinative plate of FIG. 1 and a second combinative plate of a holding frame (see FIG. 9) combined together, according to the first embodiment of the present invention.

Referring to FIG. 4, a side view of the combination of the first combinative plate 52 and the second combinative plate 43 of the holding frame 4 is shown. The through holes 45 and 46 of the holding frame 4 illustrated in FIG. 9 may be omitted. When the shelf 5 is installed, the two side frames 51 are lifted, and the slot 523 is made to accommodate the second combinative plate 43. Thus installation is accomplished. The installation can be accomplished conveniently and quickly, and there is little or no danger of an operator's fingers being scalded by a hot pressing head (not shown).

A center of the shelf 5 acts as a hot pressure area, and the first combinative plate 52 has to be arranged apart from the center of the shelf 5 in order to prevent the first combinative plate 52 from being damaged. When the shelf 5 is installed on the second combinative plate 43 via the first combinative plate 52, the shelf 5 tilts at a certain angle due to gravity acting on the shelf 5. The stop 521 is used for preventing the shelf 5 from escaping from the first combinative plate 52.

The combination of the shelf 5 and the second combinative plate 43 has the following advantages. The shelf 5 and the second combinative plate 43 can be locked without any bolts. Thus the shelf 5 and the holding frame 4 can be combined or disassembled conveniently and quickly. In operation, an operator's hand need not go near the hot pressing head, and so the operation is safe. Further, the first ends 511 of the side frames 51 each have a plurality of first U-shaped grooves 513. When the expansile screw 53 is arranged in different first U-shaped grooves 513, a different space between the expansile screw 53 and first combinative plate 51 is defined. Thus a reel of Teflon® band 150 having a different diameter can be installed on the shelf 5. A Teflon® band 150 does not need to be divided into one or more parts, and no Teflon® band 150 is wasted.

Figure 5:
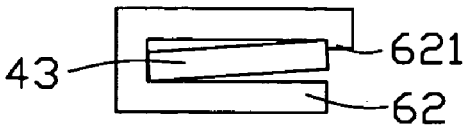
FIG. 5 is a side view of another first combinative plate and the second combinative plate of the holding frame (see FIG. 9) combined together, according to a second embodiment of the present invention.
Figure 6:
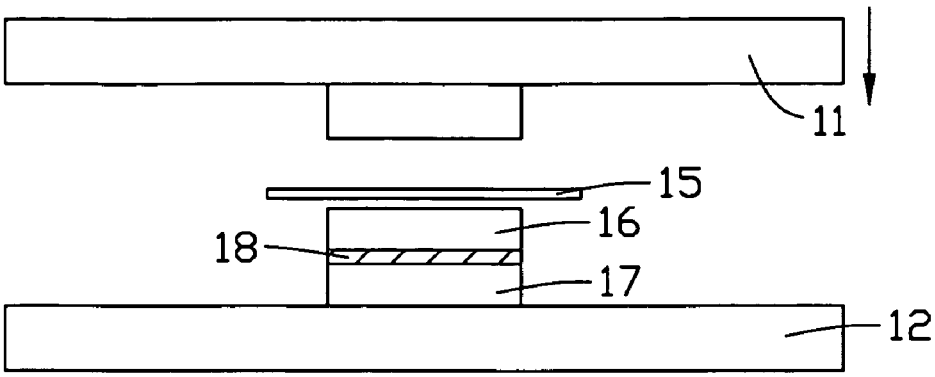
FIG. 6 (PRIOR ART)
FIG. 6 is a schematic, side view of a conventional hot press arrangement, with a driver IC to be connected to a PCB via an ACF.
Figure 7:
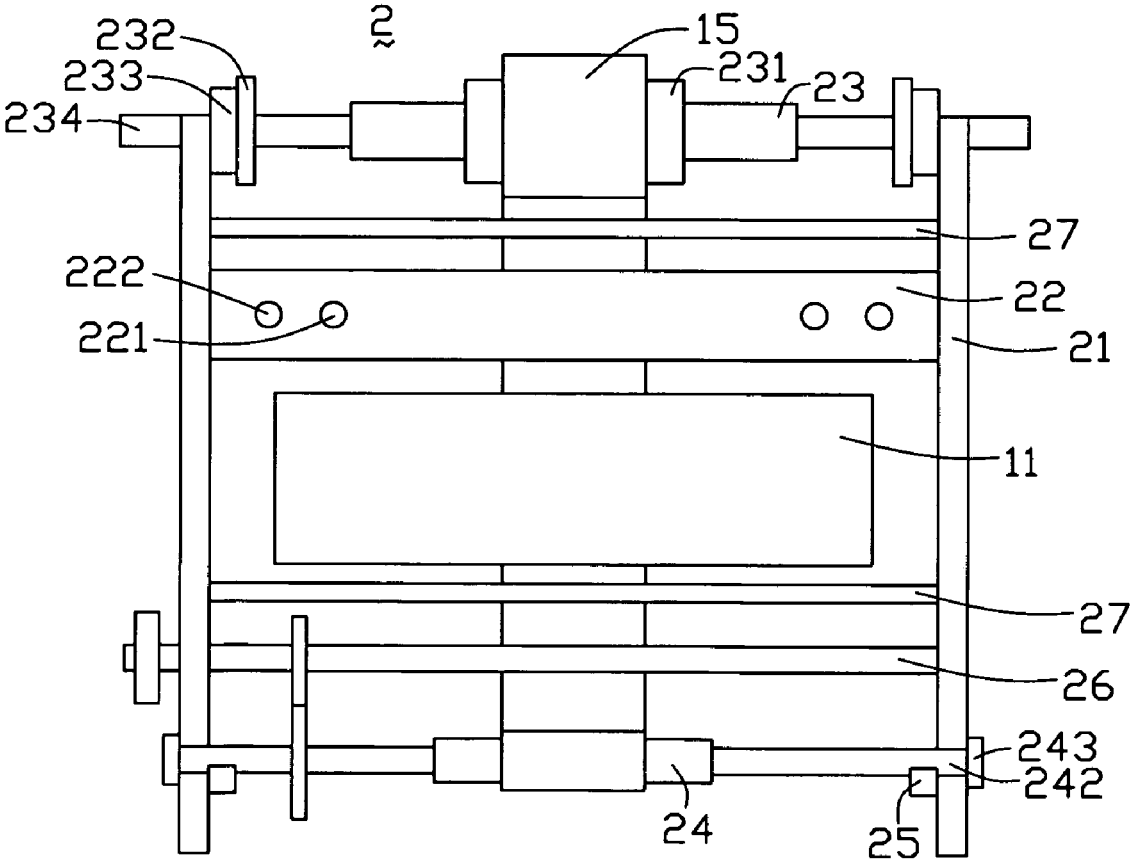
FIG. 7 (PRIOR ART)
FIG. 7 is a top view of a conventional shelf used with the hot press arrangement of FIG. 6.
Figure 8:
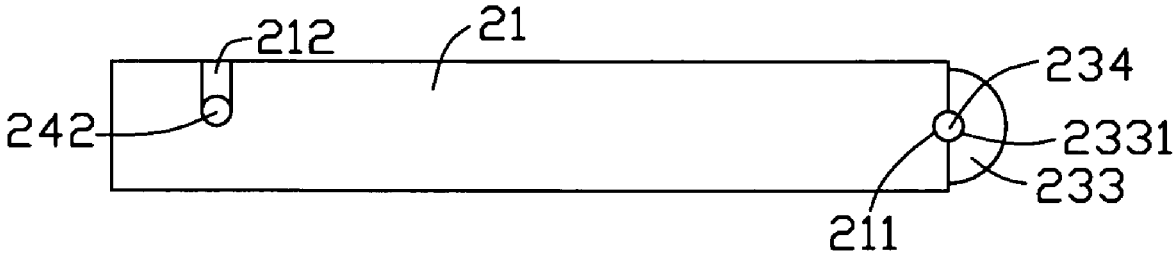
FIG. 8 (PRIOR ART)
FIG. 8 is a side view of one side frame of the shelf of FIG. 7.

A variation of a second combinative plate 62 is shown in FIG. 5. A stop 621 of the second combinative 62 is arranged at an upper portion of an opening of a slot 623.

Additionally, the first combinative plate 52 and the second combinative plate 43 can be replaced into each other, and the first combinative plate 52 should be strip-shaped.

Alternatively, the first ends 511 of the side frames 51 may each have only one first U-shaped groove 513. In such case, a length of the side frames 51 needs to be extended, so that a distance between the first U-shaped grooves 513 and the stiffener 58 is increased. This can ensure that a reel of Teflon® band 150 can be installed on the shelf 5.

It is to be understood, however, that even though numerous characteristics and advantages of the embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination of a shelf and a holding frame, wherein:

the holding frame comprises a strip-shaped plate and a rectangular cross-section; and the shelf comprises a combinative plate comprising a through slot, and a cross section of the through slot being ⊏shaped, and a stop disposed in an upper part or a lower part of an opening of the through slot, and the through slot fixing with the rectangular strip-shaped plate;

wherein the shelf comprises two side frames opposite to each other, and each side frame comprises a first end and a second end;

wherein the shelf comprises a first enrolling cylinder disposed at the first end and can rotate around an axis of the first end; and wherein the first end of each side frame comprises a plurality of U-shaped grooves, and the first enrolling cylinder has two ends, and each end of the first enrolling cylinder has a rotating shaft disposed in one of the U-shaped grooves.

2. The combination according to claim 1, wherein the shelf comprises a second enrolling cylinder disposed at the second end and can rotate around an axis of the second end.

3. The combination according to claim 1, wherein the second end of the side frames comprises a U-shaped groove, and the second enrolling cylinder has two ends, and each end of the second enrolling cylinder has a rotating shaft disposed in the U-shaped groove.

4. The combination according to claim 3, wherein the first end of the side frames comprises a plurality of U-shaped grooves, and the first enrolling cylinder has two ends and each end of the first enrolling cylinder has a rotating shaft disposed in the U-shaped groove, a length of the side frame is suited to install a reel of coiled material.

5. The combination according to claim 2, wherein the shelf comprises two stiffeners disposed between the two side frames, the two stiffeners being parallel to the first enrolling cylinder.

* * * * *